US007536949B2

(12) United States Patent
Skannerup

(10) Patent No.: US 7,536,949 B2
(45) Date of Patent: May 26, 2009

(54) PRESSING CYLINDER, PREFERABLY FOR USE IN A REFUSE CONTAINER

(75) Inventor: Kristian Skannerup, Ulfborg (DK)

(73) Assignee: Mil-TeK Balers A/S, Ulfborg (DK)

( * ) Notice: Subject to any disclaimer, the term of this patent is extended or adjusted under 35 U.S.C. 154(b) by 364 days.

(21) Appl. No.: 10/580,980

(22) PCT Filed: Dec. 2, 2003

(86) PCT No.: PCT/DK03/00823

§ 371 (c)(1),
(2), (4) Date: Jul. 21, 2006

(87) PCT Pub. No.: WO2005/053944

PCT Pub. Date: Jun. 16, 2005

(65) Prior Publication Data

US 2008/0276812 A1 Nov. 13, 2008

(51) Int. Cl.
*B30B 1/36* (2006.01)
*B30B 1/38* (2006.01)

(52) U.S. Cl. ..... 100/269.18; 100/226; 100/229 A; 100/266; 100/269.04

(58) Field of Classification Search ..... 100/214, 100/226, 229 R, 229 A, 233, 260, 265, 266, 100/267, 269.01, 269.02, 269.04, 269.16, 100/269.18, 295
See application file for complete search history.

(56) References Cited

U.S. PATENT DOCUMENTS 3,514,969 A * 6/1970 Harza ..... 62/341
3,654,855 A 4/1972 Longo
3,736,863 A 6/1973 Brucker
5,355,789 A 10/1994 Suzuki et al.
6,959,643 B1 * 11/2005 Sammons et al. ..... 100/226

FOREIGN PATENT DOCUMENTS

| | | |
|---|---|---|
| EP | 0 524608 | 1/1993 |
| GB | 2 387527 | 10/2003 |
| GB | 2387527 | 10/2003 |

* cited by examiner

*Primary Examiner*—Jimmy T Nguyen
(74) *Attorney, Agent, or Firm*—Dennison, Schultz & MacDonald

(57) ABSTRACT

A pressing cylinder, preferably for use in a refuse compressor, which when in use is preferably in a vertical position, and at the bottom is coupled to a pressing plate and at the top to a secured top plate and which can activate the pressing plate in upward and downward directions, includes preferably three cylinder sections, a first, lower cylinder section which at the bottom is attached to the pressing plate, a second, intermediate cylinder section which can be displaced telescopically in the cylinder's longitudinal direction on the first cylinder section, and a third, upper cylinder section which at the top is attached to the top plate, and which can be displaced telescopically on the second cylinder section. The cylinder can have a large diameter and operate at a correspondingly low working pressure and can therefore have a small wall thickness or be produced of materials other than steel. The pressing cylinder consequently becomes light, easy to operate and cheap to produce.

9 Claims, 5 Drawing Sheets

PRESSING CYLINDER, PREFERABLY FOR USE IN A REFUSE CONTAINER

BACKGROUND OF THE INVENTION

The present invention relates to a refuse compressor of the kind described in the introductory part of claim 1.

The known refuse compressors use a double-acting hydraulic pressing cylinder. Such a pressing cylinder needs a long stroke corresponding to the travel of the pressing plate. As it furthermore operates at a high pressure the wall thickness of the cylinder will have to be great. The pressing cylinder therefore becomes large and heavy and difficult to handle, and consequently its use is limited to large recycling centres.

SUMMARY OF THE INVENTION

It is a purpose of the present invention to describe a pressing cylinder, which does not have the drawbacks of the known pressing cylinders.

This is achieved by embodying the pressing cylinder as described in the characterising part of claim 1. This will have the effect that the length of the cylinder in its unloaded position is essentially shorter that the cylinder's length of stroke. The cylinder can have a diameter which is approximately equal to the diameter of the pressing plate. As the cylinder therefore can operate at a lower working pressure, the cylinder can be constructed with a smaller wall thickness or of other materials lighter than steel, for example synthetic materials. The pressing cylinder therefore becomes light and easy to handle. Furthermore, production costs will be low.

Compression of refuse can therefore be spread to new user groups, which so far have been prevented from the facility on account of lack of availability of usable equipment. The use of the present invention will thus make it possible for ordinary households or smaller undertakings to use compression of domestic refuse and obtain an economically attractive and environmentally-friendly sorting-at-source of the refuse. The social advantage of this can give enormous savings in connection with collection of refuse from private households and firms. As the degree of compression of the refuse—depending on the type of refuse—is 65%-85%, the transportation in connection with collection will be correspondingly reduced.

Claim 2 describes preferred stop organs, which come to rest against each other in the extended position and limit the length of stroke.

By the embodiment described in claim 3 it is achieved that the individual cylinder sections for a pressing cylinder according to the invention cannot rotate in relation to each other.

Claim 4 relates to preferred means for attachment of a diaphragm to the pressing cylinder according to the invention.

Claim 5 describes the advantage of the fact that a torque acting on the cylinder sections by the turning of the windings in a spring is counter-acted by another spring.

Claim 6 describes the advantage of the fact that the spring can be taken up in the hollow space in the third cylinder section in the retracted position of the pressing cylinder.

BRIEF DESCRIPTION OF THE DRAWING

The invention is explained in detail below with reference to the drawing in which.

DESCRIPTION OF THE PREFERRED EMBODIMENTS

Figure 1:
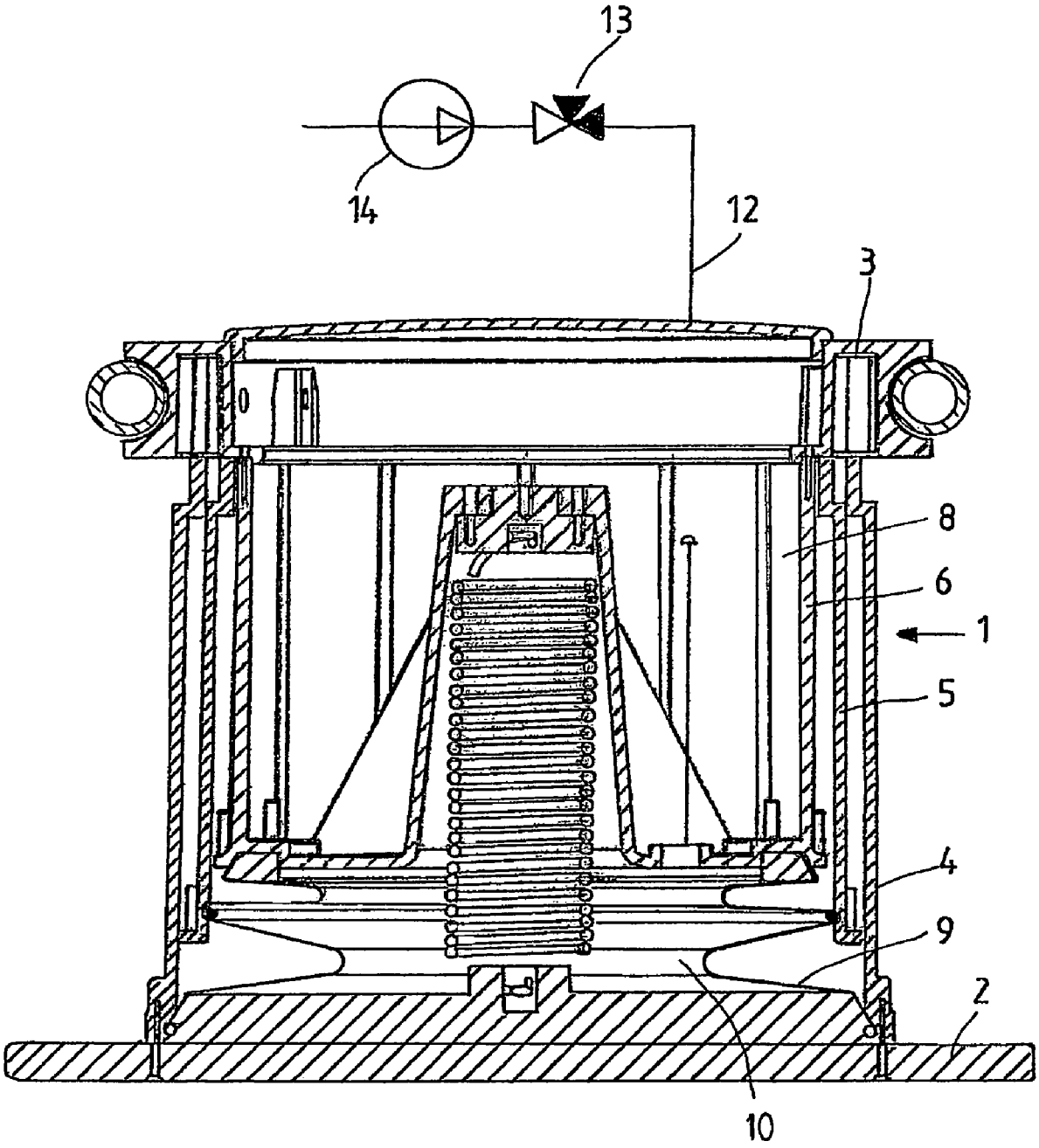
FIG. 1 shows a section in the pressing cylinder according to the invention in its retracted position.
Figure 2:
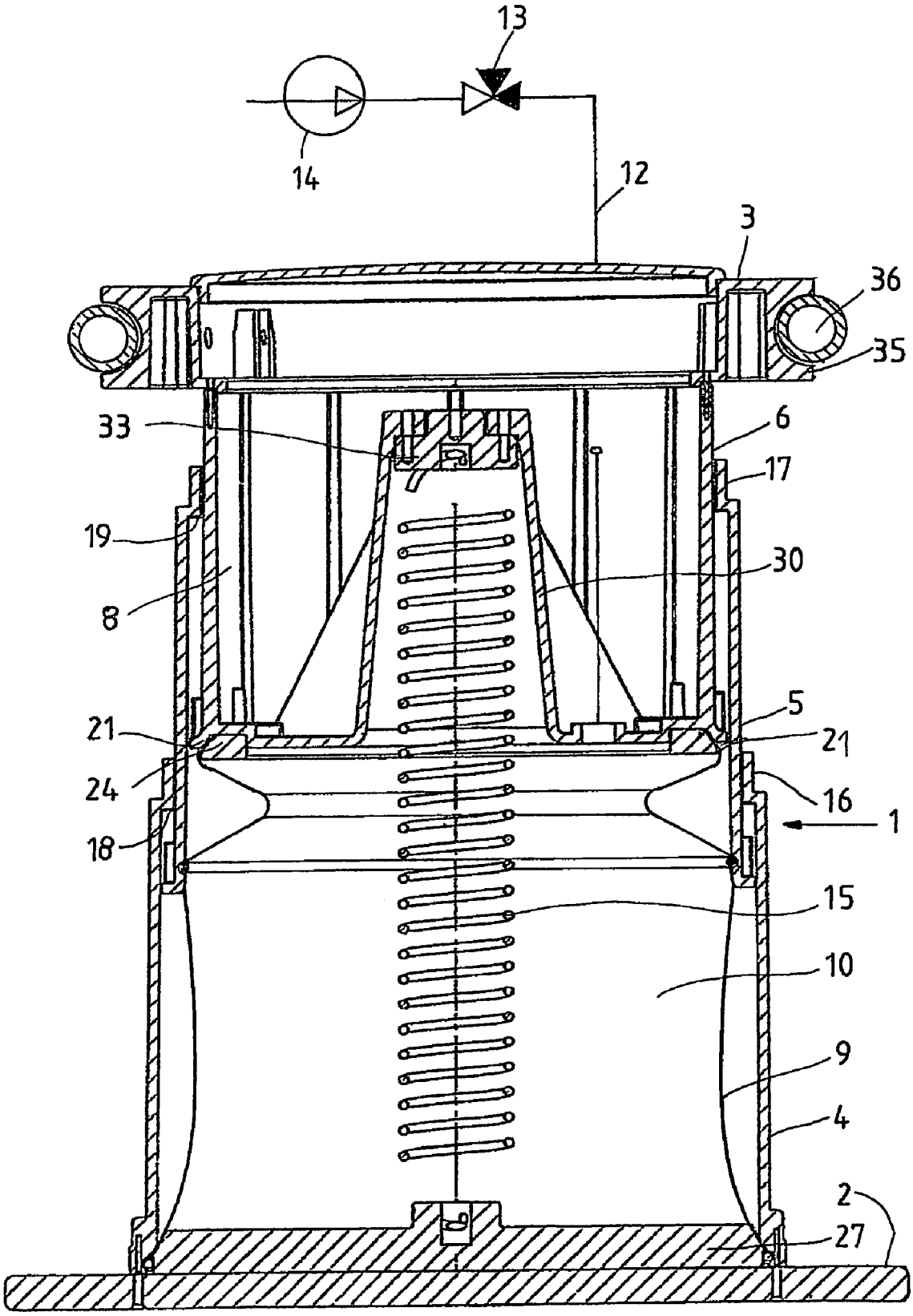
FIG. 2 shows the pressing cylinder in an intermediate position.
Figure 3:
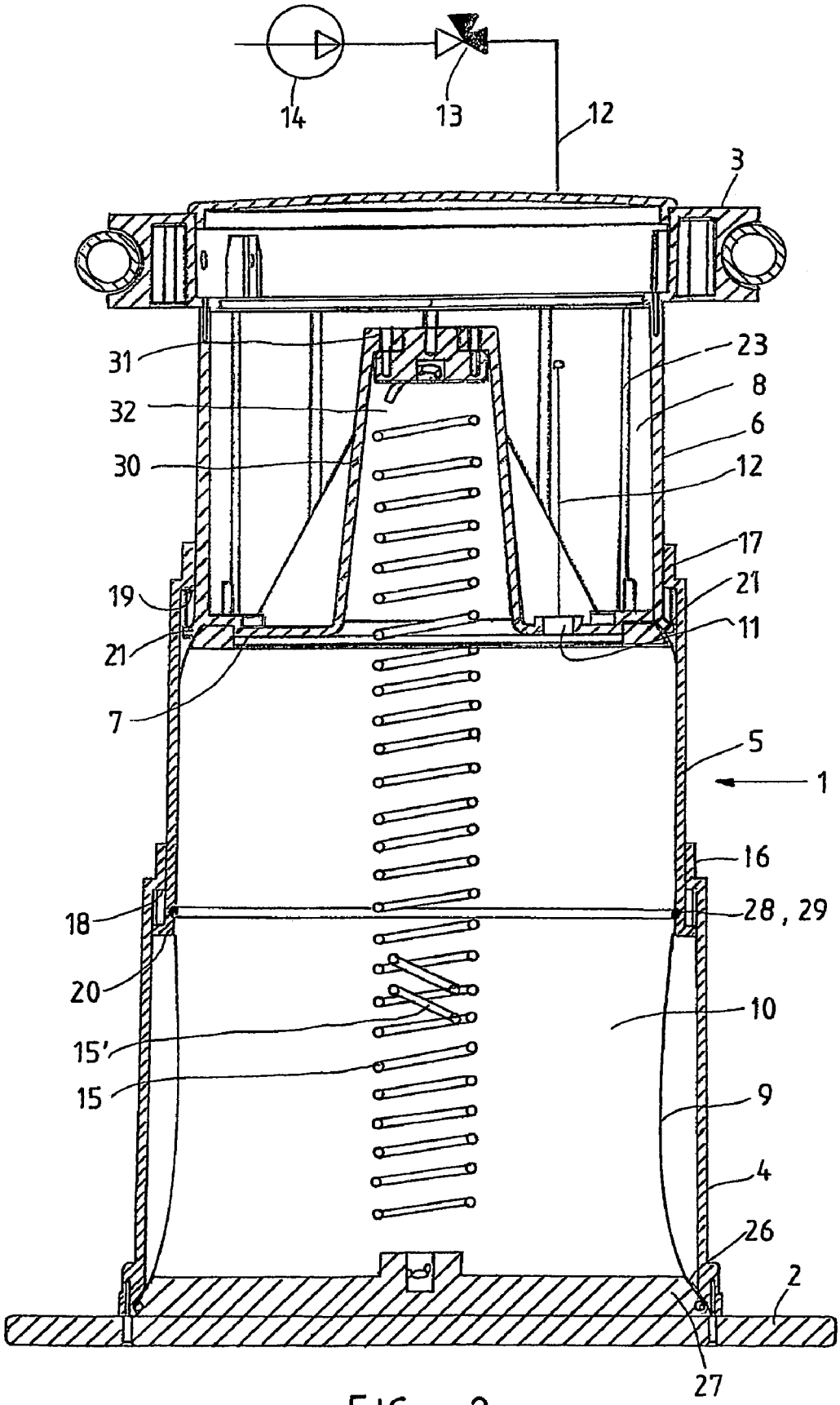
FIG. 3 shows the pressing cylinder in its extended/prolonged position.
Figure 4:
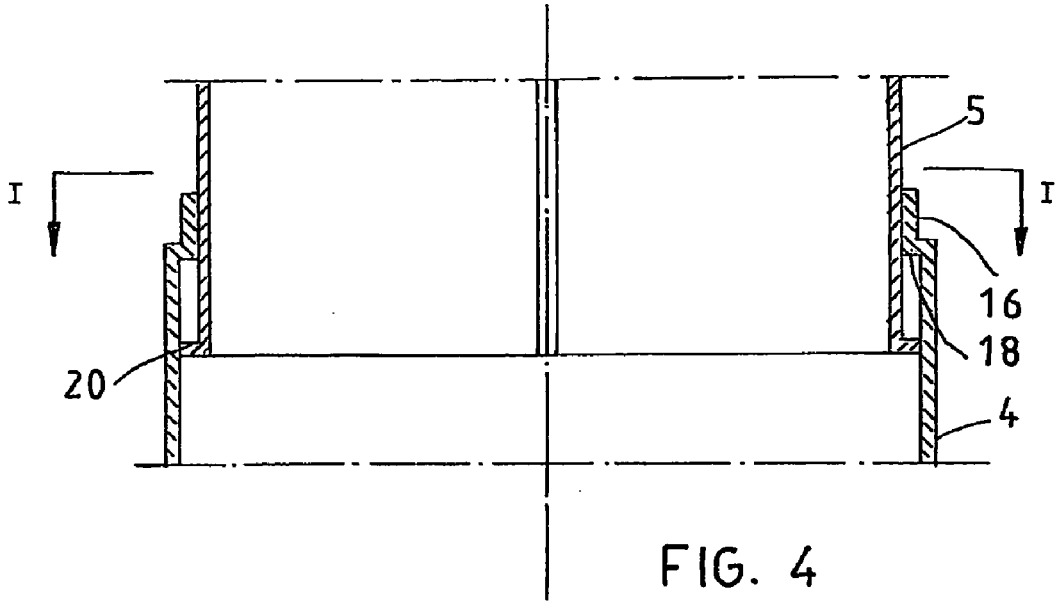
FIG. 4 is a sectional illustration of a cylinder barrel in the first and second cylinder sections.
Figure 5:
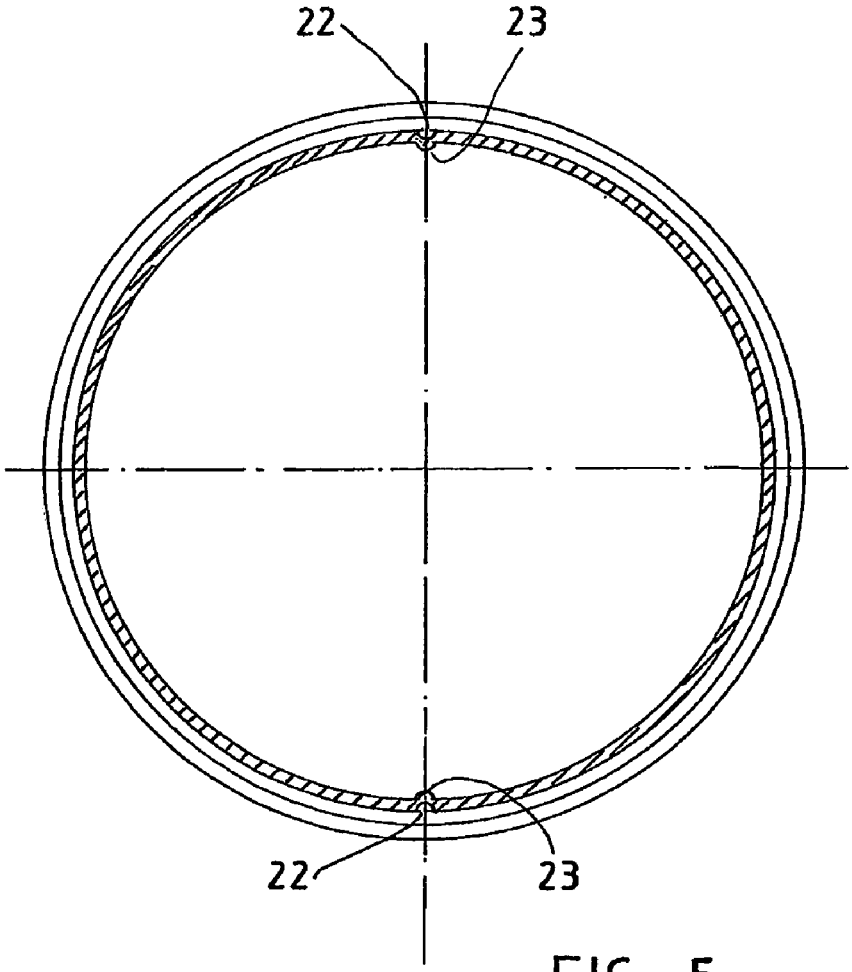
FIG. 5 shows a section after the line I-I in FIG. 4.

As shown, a pressing cylinder 1 is at the bottom coupled to a pressing plate 2 and at the top to a top plate 3, which is fixed to the machine frame. The pressing cylinder is normally vertically oriented and can activate the pressing plate in the upward or downward directions.

As shown, a pressing cylinder according to the invention is composed of a number—preferably three—of cylinder sections, namely a first and bottom cylinder section 4, which at the bottom is fixed to the pressing plate 2, a second and intermediate section 5, which can be displaced telescopically in the longitudinal direction of the cylinder in the first cylinder section, and a third and upper cylinder section 6, which can be displaced telescopically in the second cylinder section. The third cylinder section 6 is at its bottom embodied with a bottom plate 7, which together with the cylinder barrel of the section 6 and the top plate 3 delimits a closed hollow space 8.

Internally in the cylinder—between the periphery of the bottom plate 7 and the cylinder barrel of the cylinder section 4 below at the pressing plate 2—there is an approximately cylinder-shaped flexible diaphragm 9 clamped in the extended position of the cylinder. The diaphragm can be made of rubber. This creates an airtight space 10 inside the cylinder between the bottom plate 7, the pressing plate 2, and the diaphragm 9.

The bottom plate 7 is embodied with a connecting opening 11 for compressed air supplied to the space 10 through a pipe 12 from a three-way valve 13. In an initial position the three-way valve opens for compressed air from a compressor 14. In a second position the three-way valve 13 opens the space 10 to the atmosphere, in which position the cylinder sections 4, 5 and 6 are pulled together by an extension spring 15.

The cylinder barrels in the first and the second cylinder sections 4 and 5 are at the top embodied with a short cylinder-shaped segment, respectively 16 and 17, which have a smaller inner and outer diameter than the cylinder barrels of these cylinder sections. The result is an internal circular ring-shaped collar, respectively 18 and 19. At their bottom the cylinder barrels in the cylinder sections 5 and 6 are embodied with an outward protruding edge, respectively 20 and 21, which can co-operate with the collars 18 and 19, when the pressing cylinder is in its extended position.

The segments 16 and 17 are internally embodied with one or more guiding edges 22, which can have a cross section like a semi-circle and are oriented in the direction of a carrier in the segment. The external side of the cylinder barrels in the sections 5 or 6 are embodied with grooves 23, which are oriented in the direction of a carrier in these sections. These grooves have a cross section, e.g. as a semi-circle, so that they can engage with the guiding edges 22. This prevents that the individual cylinder sections can turn in relation to each other.

As shown, the diaphragm 9 is fixed to the bottom plate 7 in the cylinder section 6 by being clamped between an oblique surface 21' on the under side of the edge 21 and a surrounding clamping ring 24, which can be accommodated in the bottom plate 7 in a depression in the latter. The diaphragm 9 is fixed to the pressing plate 2 by being clamped between an internal oblique surface at the bottom of the cylinder barrel on the first cylinder section 4 and a clamping plate 27, which is mounted on the upper surface of the pressing plate 2. The diaphragm 9 can furthermore be fixed to the bottom end of the cylinder barrel in the second cylinder section 5 by a clamping ring 28, which engages in a circumferential groove in the cylinder barrel.

As shown, the extension spring can be embodied as two concentric springs 15 and 15', which have their pitches in mutually opposite directions. A torque which is produced by a turning of the windings in one spring during its movement will be counter-acted by a turning in the opposite direction of the other spring.

As shown, the bottom 7 of the third cylinder section is drawn up into a truncated raised part 30 with a plane top side 31 and an internal hollow space 32, which can approximately take up the spring 15 when the pressing cylinder is in its compressed position. In the bottom of the top side 31 is mounted a clamping member 33, and the top side of the clamping plate 27 is embodied with a clamping member 34. These two clamping members can anchor the ends of the spring 15.

Figure 6:
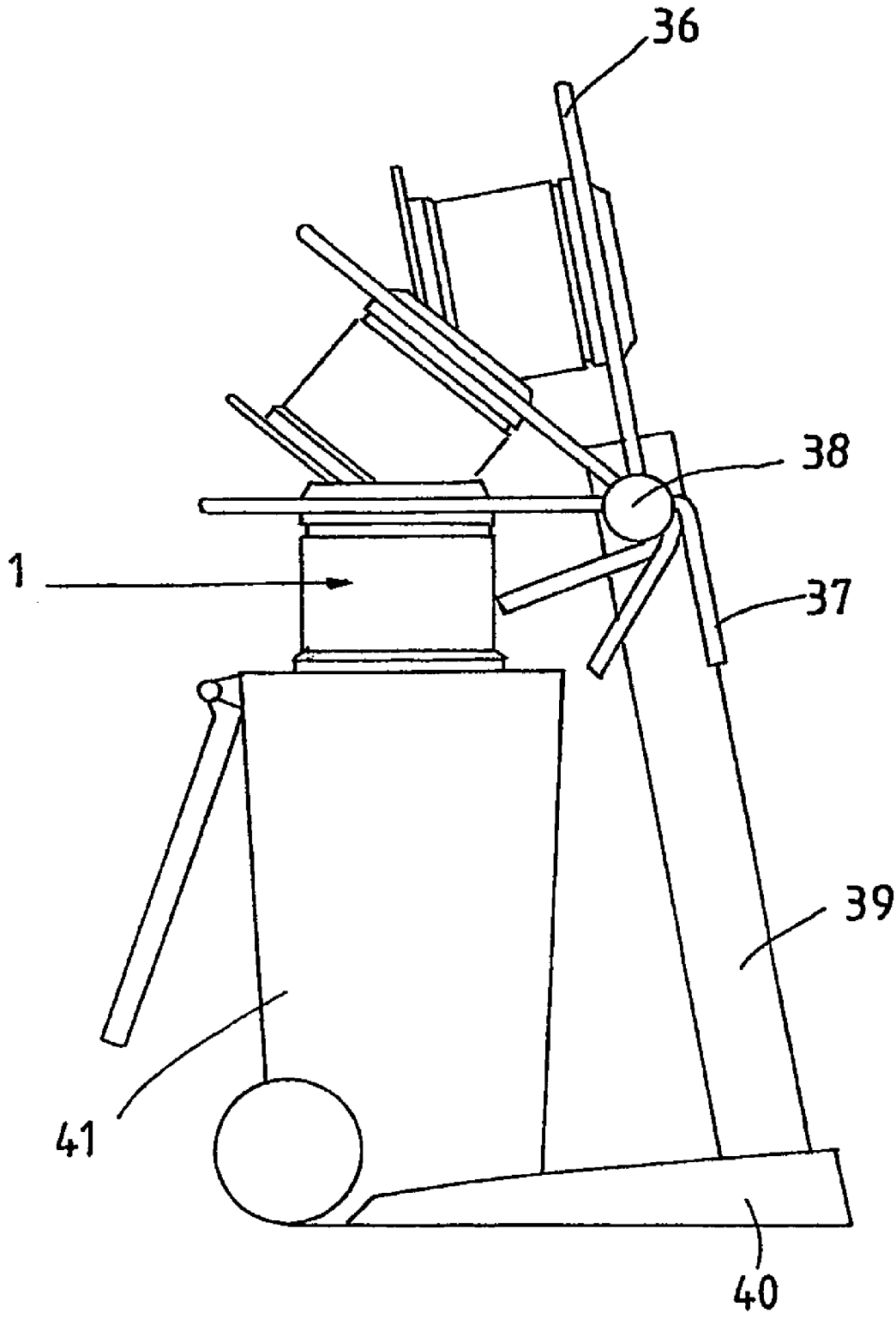
FIG. 6 shows an embodiment of a refuse compressor with a pressing cylinder according to the invention.

As shown, the top plate 3 can along the outer edge be embodied with a semi-circular cutout 35 which can accommodate a holding organ, for example a pipe clamp 36, which as shown in FIG. 6, is swingably hinged on hinges 38 to a supporting column 39, which is mounted on a foot 40. As the pressing cylinder is very light it can be tilted manually with the pipe clamp by means of a handle 37. In/at the hinges is arranged a retractable locking mechanism, for example a pawl mechanism, which can lock the pipe clamp 36 when it is horizontal and the pressing cylinder 1 is in its active position and in a vertical or approximately vertical position in which the pressing cylinder is not in use, and in which position a refuse container 41 can be placed in/on the foot 40.

The above is only an example of the use of a pressing cylinder according to the invention in a refuse compressor. Such a refuse compressor takes up a minimum of space and can be operated manually.

The invention claimed is:

1. Pressing cylinder for use in a refuse compressor for compression of refuse, the pressing cylinder being oriented vertically and coupled at a bottom portion to a pressing plate and at a top portion to a top plate fixed in a frame, comprising:

means to activate the pressing plate in upward and downward directions of the pressing cylinder, a plurality of cylinder sections comprising a first and lowest cylinder section having a bottom portion fixed to the pressing plate, a second and intermediate cylinder section which is displaceable telescopically in a longitudinal direction in the first cylinder section, and a third and upper cylinder section, which at a top portion is attached to the top plate, the second and intermediate cylinder section is displaceable telescopically on the third and upper cylinder section, and the third and upper cylinder section is in the second and intermediate cylinder section the third cylinder section at a bottom portion comprising a bottom plate which together with the third cylinder section and the top member delimits a closed hollow space in the third cylinder section, an approximately cylinder-shaped bendable diaphragm disposed internally within the pressing cylinder between a bottom of the bottom plate and a bottom of the first cylinder section at the pressing plate, the bendable diaphragm having one end clamped to the bottom portion of the third and upper cylinder section and an opposing end clamped to the bottom portion of the first and lowest cylinder section an airtight space being created internally in the pressing cylinder between the bottom plate, the pressing plate and the diaphragm, the bottom plate comprising an inlet opening for a supplying a compression medium to the airtight space, means for supplying the compression medium comprising a pipe connected at one end to the inlet opening and at an opposite end to a three-way valve, which in a first position opens to a source of the compression medium, and in a second position opens the airspace to the atmosphere, and an extension spring clamped in the pressing cylinder between the bottom plate, the spring having one end clamped to the bottom plate and an opposing end connected to the pressing plate internally in the pressing cylinder and the pressing plate, which extension spring contracts the cylinder sections at the end of a working stroke.

2. Pressing cylinder according to claim 1, additionally comprising a compressor connected to the three-way valve to supply compressed air as the compression medium.

3. Pressing cylinder according to claim 1, wherein the diaphragm is a rubber diaphragm.

4. Pressing cylinder according to claim 1, wherein the first and the second cylinder sections at top portions thereof comprise a short cylinder-shaped segment having an inner and outer diameter smaller than those of the cylinder sections, creating an internally circular ring-shaped collar which co-operates with an outwardly directed circumferential edge at the bottom portions of, respectively, the second and the third cylinder sections, when the pressing cylinder is in an extended position.

5. Pressing cylinder according to claim 4, wherein the cylinder-shaped segments internally comprise at least one guiding edge, which is oriented in a direction of a carrier in the segment, and an external side of the cylinder sections comprise grooves which are oriented in a direction of a carrier, and have a cross section constructed and arranged to co-operate with the guiding edges.

6. Pressing cylinder according to claim 1, wherein the diaphragm is attached to the bottom plate by secure clamping between a circumferential oblique surface on an under side of a bottom edge of the third cylinder section and a clamping ring, accommodated in a depression in the bottom plate, and is attached to the pressing plate by secure clamping between an internal oblique surface at a lower end of the first cylinder section and a clamping plate mounted on an upper side of the pressing plate.

7. Pressing cylinder according to claim 6, wherein the diaphragm is fixed to a lower end of the second cylinder section by a clamping ring which is engaged in a circumferential groove internally in the second cylinder section.

8. Pressing cylinder according to claim 1, wherein the extension spring comprises two concentric springs with oppositely directed pitches, forming a double spring.

9. Pressing cylinder according to claim 6, wherein the bottom plate at a middle portion is drawn up into a raised part shaped as a truncated cone with a planar top surface and an internal hollow space, which can accommodate the extension spring when the pressing cylinder is in a compressed state, a clamping member being provided at a bottom of the planar top surface and on a top side of the clamping plate for attachment of two ends of the extension spring.

* * * * *